United States Patent [19]

Moraw

[11] 4,108,550

[45] Aug. 22, 1978

[54] APPARATUS FOR LIFTING AN ELECTROSTATICALLY CHARGED FLEXIBLE RECORDING MATERIAL

[75] Inventor: Roland Moraw, Naurod, Fed. Rep. of Germany

[73] Assignee: Hoechst Aktiengesellschaft, Fed. Rep. of Germany

[21] Appl. No.: 704,593

[22] Filed: Jul. 12, 1976

Related U.S. Application Data

[63] Continuation of Ser. No. 422,683, Dec. 7, 1973, abandoned.

[30] Foreign Application Priority Data

Dec. 11, 1972 [DE] Fed. Rep. of Germany ..... 2260570

[51] Int. Cl.[2] ..... G03B 15/00

[52] U.S. Cl. ..... 355/133; 355/9; 355/16

[58] Field of Search ..... 355/133, 3 R, 9, 12, 355/16; 346/74 TP; 340/173 TP

[56] References Cited

U.S. PATENT DOCUMENTS

| | | | |
|---|---|---|---|
| 3,692,404 | 9/1972 | Lester et al. | 355/9 |
| 3,715,156 | 2/1973 | Levy | 355/16 |

*Primary Examiner*—Richard L. Moses
*Attorney, Agent, or Firm*—James E. Bryan

[57] ABSTRACT

An apparatus for peeling off an adherent, electrostatically charged, flexible recording material from an electroconductive supporting plate, comprising an electroconductive supporting plate adapted to contact one side of the material, a guide for the recording material so mounted as to project beyond an image plane on the supporting plate in the direction in which the recording material is to be peeled off, a holding element positioned upstream of the guide and the supporting plate, and a pulling device for exerting a lateral pull on the recording material when the material is held by the holding element, whereby the material is progressively separated from the image plane in a wedge-like manner.

4 Claims, 9 Drawing Figures

IX

APPARATUS FOR LIFTING AN ELECTROSTATICALLY CHARGED FLEXIBLE RECORDING MATERIAL

Figure 1:
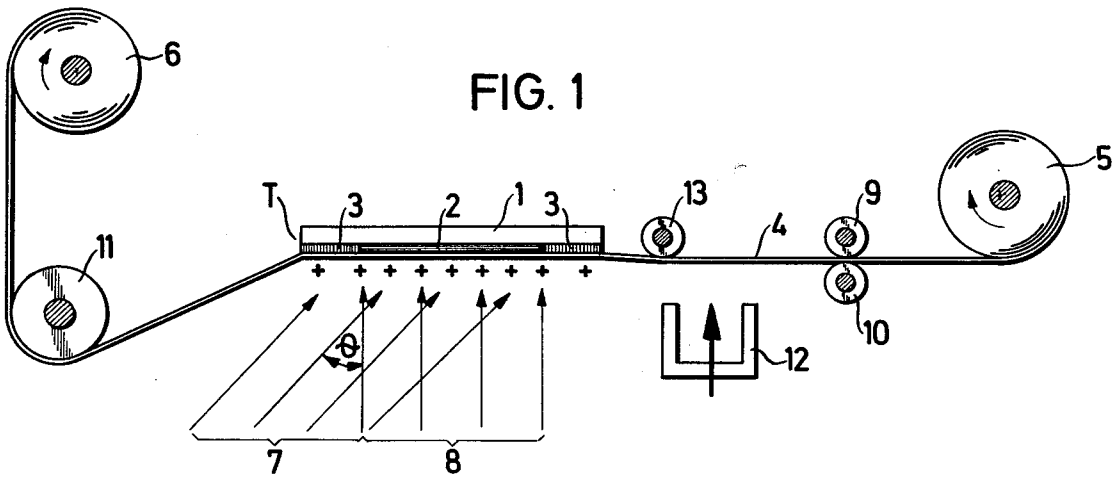

This is a continuation of application Ser. No. 422,683, filed Dec. 7, 1973, now abandoned.

The present invention relates to an apparatus for lifting an adherent, electrostatically charged, flexible recording material, in particular a film provided with a thermoplastic photoconductor layer, from an electrically conductive support.

Films provided with thermoplastic photoconductor layers may be used, e.g., as recording materials for the preparation of deformation images, and in particular for recording phase holograms.

Frequently, the thermoplastic photoconductor layers are applied to a rigid support, such as glass or a rigid plastic material, provided with an electroconductive intermediate layer consisting, e.g., of tin oxide or aluminum. It was found, however, that for recording rapidly changing images, a flexible supporting material is to be preferred for the thermoplastic photoconductor layer. By using a flexible material, it becomes possible to store the recording material in the form of rolls, which not only saves space, but renders it possible to easily replace the recording material by forward movement of the film.

Consequently, the structure of the recording material must be altered such that a flexible support, e.g. a web-like support, is used which is covered by a thermoplastic photoconductor layer. The flexible supporting material then may be electrostatically attached to a conductive, rigid, preferably transparent support in order to determine the plane of reproduction. According to another modification, the photoconductor layer and the thermoplastic layer are two separate layers which are superimposed upon one another.

For the preparation of recordings, the materials are normally electrostatically charged in the absence of light and then image-wise exposed. In the case of recording materials consisting of two separate layers, i.e. a photoconductor layer and a thermoplastic layer, charging is repeated after exposure. The material is then subjected to a controlled heat influence, so that the charge image is transformed into a relief image. If desired, the relief image may be deleted again by heating to an elevated temperature. It is known that not only conventional images, but also holograms may be recorded on such recording materials and also erased therefrom.

A process for combining a flexible, photoconductive film with a recording film backed by a supporting surface is already known (German Offenlegungsschrift No. 1,797,156), according to which an electrical potential is produced between the supporting surface and the electrically conductive layer of the photoconductive film, which causes the two films to be continuously electrostatically attracted to each other. The difficulty with such a process, however, is how the two films attracted by electrostatic forces are to be separated from each other. It was found that the application of a potential causes an adhesion which is so strong that the films cannot be easily lifted and that their separation involves the risk of disturbing the recording produced.

It was the object of the present invention to provide an apparatus by means of which an adherent, electrostatically charged recording material may be easily and reliably separated from the electroconductive supporting surface.

This object is achieved by an apparatus for lifting an adherent, electrostatically charged, flexible recording material from an electroconductive supporting plate, in which guide elements for the recording material are arranged so that they project from the plane of a supporting plate and the guide elements, in cooperation with holding elements, draw the recording material under lateral pull in a wedge-like direction from the supporting plate. Preferably, the guide elements are arranged in a manner such that the wedge between the plane of the supporting surface and the recording material forms an angle of at least about 10°. In this manner, it is achieved that the tension to be applied is so low that the material may be lifted by means of a small apparatus, without distorting the recording material itself. The recording material may be composed of single sheets of film. Preferably, however, the recording material used is in the form of a web.

Separation of the material may take place from a flat or from a curved supporting surface, and in the case of a curved plane, this plane is defined as the tangent plane. The guide elements required for lifting the material may be stationary at the lifting point, or they may describe an arched or a straight path.

Figure 2:
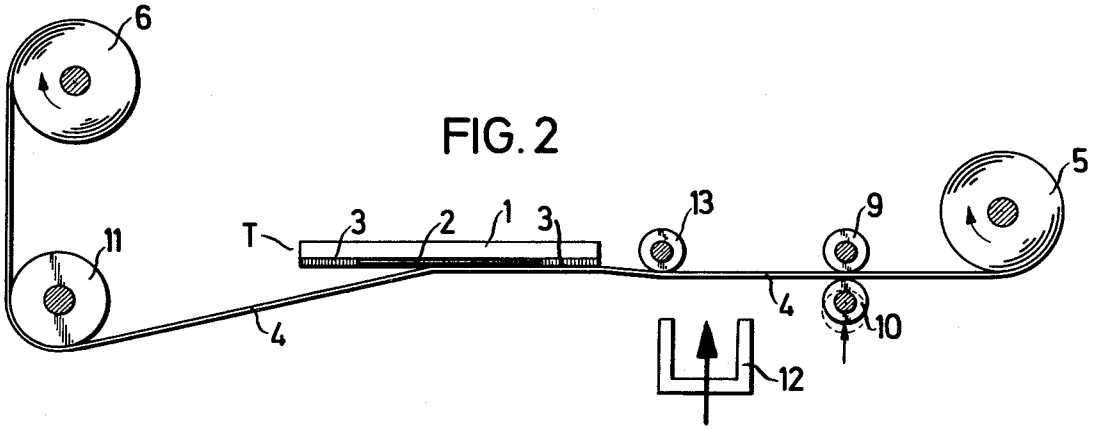
Figure 3:
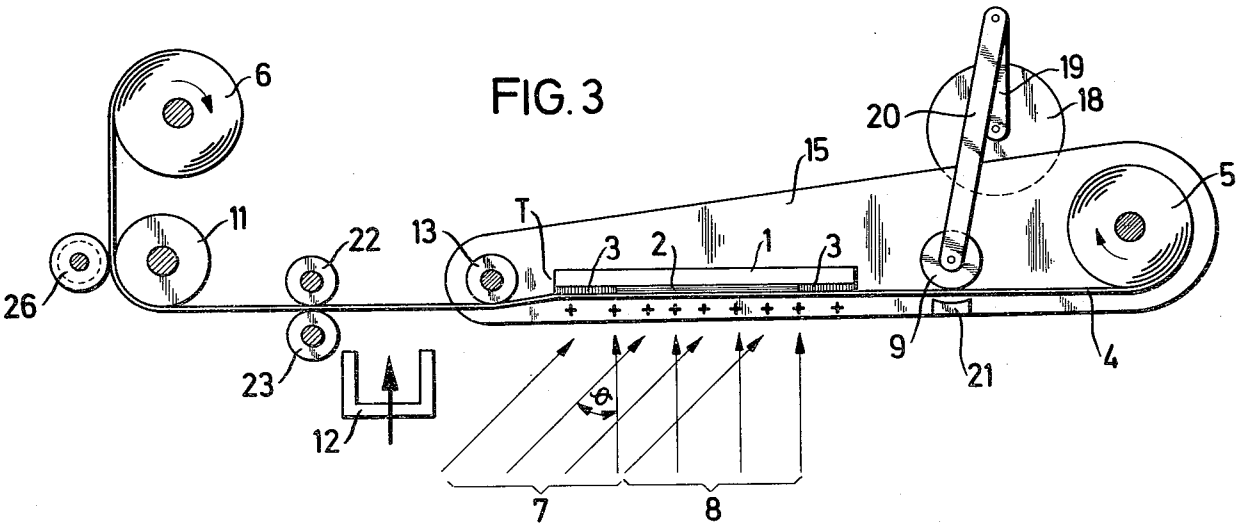
Figure 4:
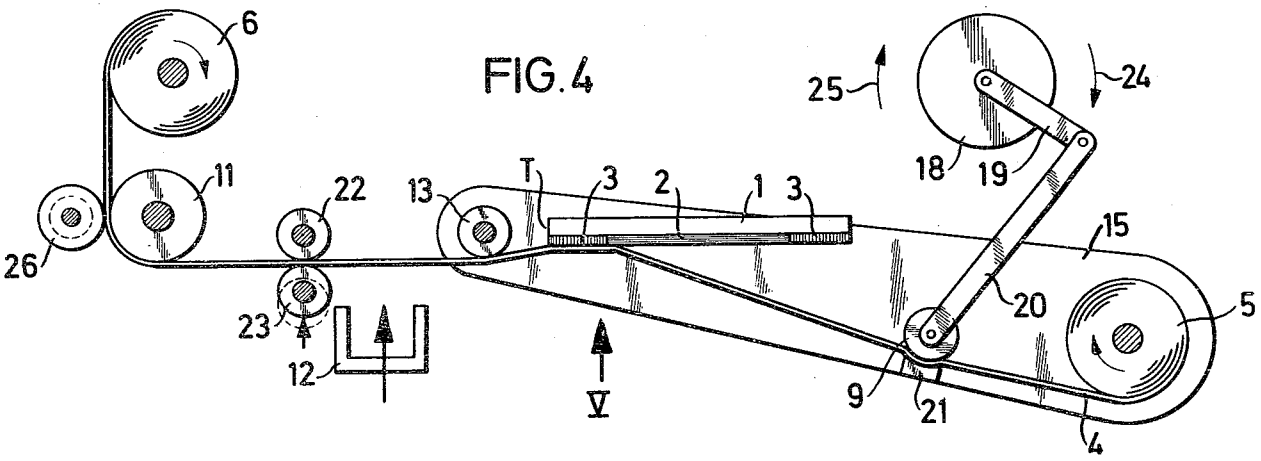
Figure 5:
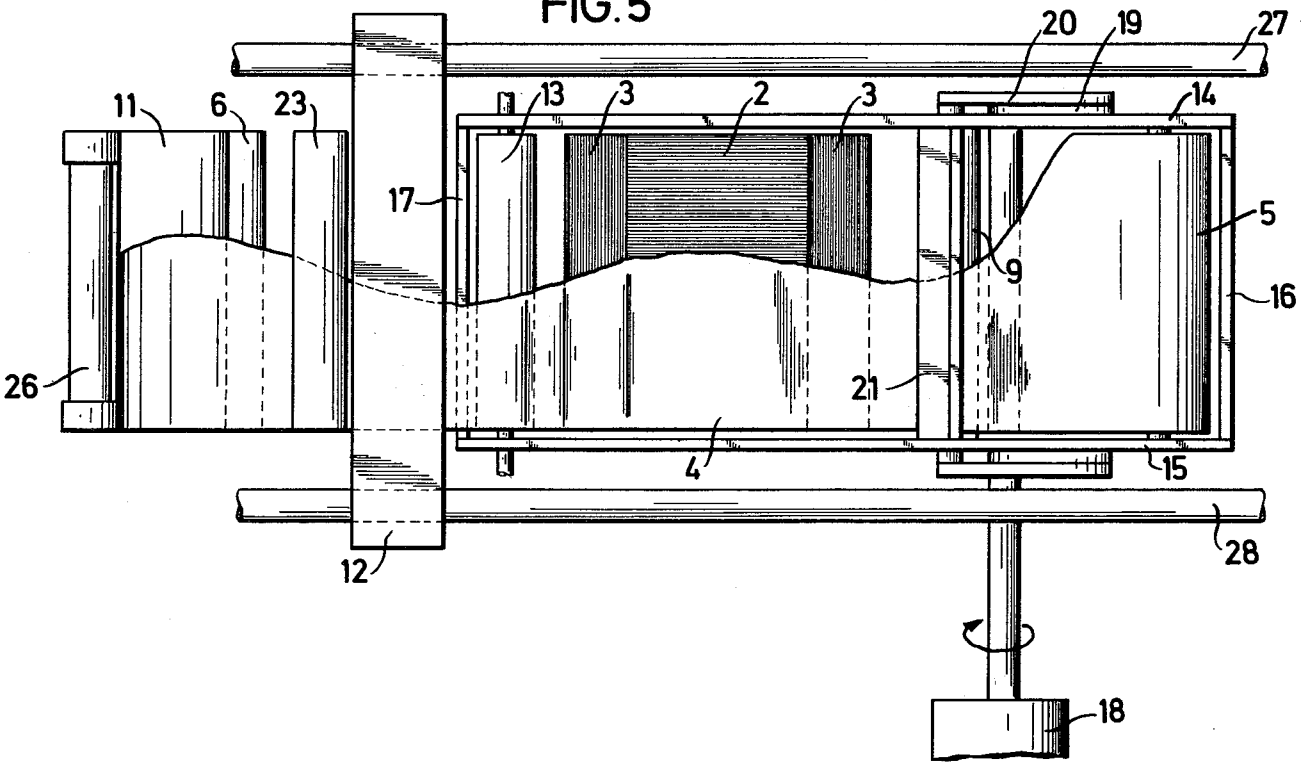

In the following, the invention will be described in more detail by reference to the embodiments shown in the drawings in which:

FIGS. 1 and 2 show top views of an embodiment in which the guide elements are stationary, FIGS. 3 to 5 show an embodiment in which the guide elements are moved along a curved path, and FIGS. 6 to 9 show an embodiment in which the guide elements move along a straight path.

Referring now to FIG. 1, a support T is composed of a glass plate 1 with a transparent, electroconductive layer 2 thereon which is provided with reinforced electrodes 3. The electroconductive layer 2, whose surface resistance is about 20 ohms/square, may be composed, e.g., of tin oxide. The electrodes are composed of a layer of higher conductivity, in the present case, e.g., of a vapor-deposited gold layer. Plates of this type are commercially available and may be obtained, e.g., from Deutsche Balzers GmbH., Geisenheim/Rhein, Germany, under the designation "Anell".

The recording material 4 is in the form of a web composed of a dielectric base film with a thermoplastic photoconductor layer on its outer surface. The recording material 4 is transported in sections from the supply roll 5 to the take-up roll 6. In FIG. 1, the recording material 4 is charged, and thus adheres firmly to the supporting plate T. For holographic exposure, it is illuminated with two coherent light beams 7 and 8, which intersect at an angle $\phi$. It has proved to be very advantageous to arrange the individual structural elements for charging and for the film transport in such a manner, flat to the image plane, that holographic exposures under an angle $\phi$ of about 45° to the surface or to the surface normal, respectively, of the supporting plate T are still possible, without the light beams being obstructed by the required structural elements.

After exposure, a voltage is briefly applied to the electrodes 3 so that the electroconductive layer 2 is heated and develops the charge image on the recording material 4 to form a deformation image. The deformation image, e.g. a phase hologram, then may be used for reproduction by transmitted light or by a reflex process.

If a reflex process is to be used, the layer 2 need not be transparent. If the material is exposed in the conventional manner under an image showing a directly recognizable information, the corresponding phase image of the original is obtained as the deformation image.

A deformation image may be erased again by heat action. Either immediately following the first imaging, or after several imaging/erasing cycles, the section of recording material utilized must be replaced, and for this purpose the charged recording material must be lifted from the supporting plate T. This process is shown in FIG. 2. During the lifting operation, the recording material 4 is held by a suitable holding element. Advantageously, this first step is initiated by hand, whereas the following steps are preferably actuated by switches mounted in appropriate positions. In FIG. 1, the recording material is held by a stationary guide pulley 9 and a loose pulley 10, which firmly presses upon the guide pulley 9 during the lifting step only, the pulleys 9 and 10 being simultaneously stopped from rotating. In this manner, the tension required for lifting the recording material 4 from the supporting plate T is prevented from being transmitted to the supply roll 5. Too tight a winding of the thermoplastic recording material 4 may cause mechanical damage to its surface, and may in particular cause the thermoplastic photoconductor layer to stick to the back of the base film.

In order to create a progressive air-wedge between the supporting plate T and the recording material 4, the take-up roll 6 is rotated over a slipping coupling, and the tension in the recording material 4 is transmitted to the deflector roll 11 which projects from the image plane. The air wedge thus formed must not be below about 10°, because otherwise the tension becomes too strong. While the recording material 4 is lifted in the form of a wedge from the supporting plate T, the rolls 6 and 11 rotate through a few degrees only, depending upon the specific geometrical arrangement of the various structural elements. Roll 11 is particularly adapted for controlling the sequence of operations, by means of cams attached thereto which operate contact switches. After the lifting operation has reached its final stage, the pulleys 9 and 10 are released and, at the same time, the pulley 10 is lifted from the pulley 9. Then a section of the recording material 4 corresponding to one image width is wound from the supply roll 5 and upon the take-up roll 6. It was found to be of advantage to exceed the width of the image by 1 to 2 centimeters at each side, because undesirable residual charges may be present in the marginal areas of the recording material, approximately opposite to the electrodes 3. The transport of the recording material 4 — which in the beginning is still charged — past the plane of the supporting plate T is facilitated by the slightly projecting roll 13 which is arranged adjacent to the supporting plate T, at the side of the peak of the air wedge. Advantageously, the deflector roll 11 is of such a size that one full rotation corresponds to the length of recording material to be transported. Preferably, the distance of the pulleys 9 and 10 from the supporting plate T should also correspond to the length of recording material to be transported, so that any pressure marks which may be formed do not affect the image areas. It has been found to be of advantage to feed recording material of this type from the back only. In this manner it is ensured that the surface is not damaged in the image areas.

After completion of the recording cycle and forward movement of the recording material, the new section of recording material 4 facing the supporting plate T is electrostatically charged so that it is attracted by the supporting plate T. For this purpose, a corona 12 is moved to and fro past the section of the recording material 4 opposite to the supporting plate T, a high voltage being applied to the corona 12 only in the area of the conductive transparent layer 2.

In specific cases, appropriate modifications may be made to the apparatus shown in FIGS. 1 and 2. Thus, the angle of the air wedge shown in the embodiment illustrated by FIGS. 1 and 2 may be made increasingly smaller the more the lifting operation proceeds, so that a stronger pull results. Further, it would be preferable if the tension required for the lifting operation would not originate from the take-up roll 6, because such tension causes a correspondingly tight winding of the recording material. This may have adverse consequences in certain cases, such as an increased sticking tendency or damaging of the already recorded deformation images. A suitably modified arrangement can be seen from FIGS. 3 to 5, of which FIGS. 3 and 4 show two different phases of operation, while FIG. 5 is a side elevation corresponding to the phase shown in FIG. 4.

FIG. 3 indicates the exposure of the charged recording material 4. The supporting plate T and the projecting roll 13 are fixedly mounted. The supply roll 5 and the lockable guide pulley 9 are set in a frame which can be swivelled about the axis of roll 13 and is composed of lower and upper parts 14 and 15 and side bars 16 and 17 (see FIG. 5).

In order to lift the recording material as shown in FIG. 4, the pulley 9, held in slotted guides within the frame 14 and 15, is pressed by a push rod system 19 and 20 moved by a motor 18 against a jaw 21 fastened to the frame and adapted to the shape of the pulley, so that the recording material 4 is arrested in this position. At the same time, the rolls 22 and 23 are closed and locked. Upon further movement of the push rod system 19 and 20 in the direction of the arrow 24 (FIG. 4), the entire frame 14, 15, 16 and 17 is swivelled and the charged recording material 4 is lifted from the supporting plate T. When the push rod system 19 and 20 starts moving back, in the direction of the arrow 25, the recording material 4 is released by the pulley 9. At the same time, the rolls 22 and 23 are released. The recording material 4 is then moved forward by one section by means of the deflector roll 11, in cooperation with the roll 26 whose counter-pressure acts on the margins only. Thus, the transported recording material 4 is wound upon the take-up roll 6 under slight tension only. Subsequently, the recording material 4 fed to the supporting plate T is charged by means of a corona 12 which is moved on rods 27 and 28 (FIG. 5) by a push rod system (not shown).

Figures 6, 7, 8:
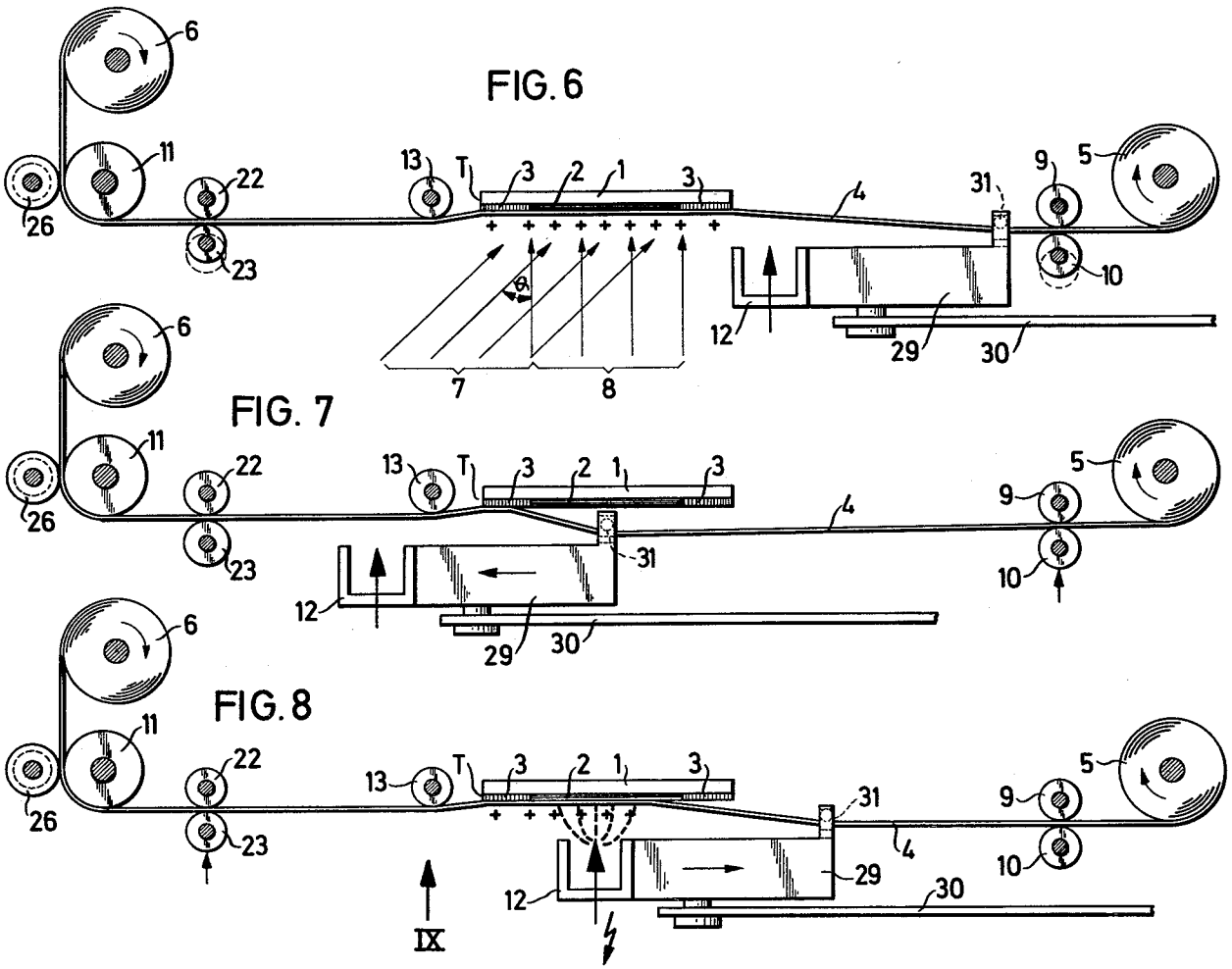
Figure 9:
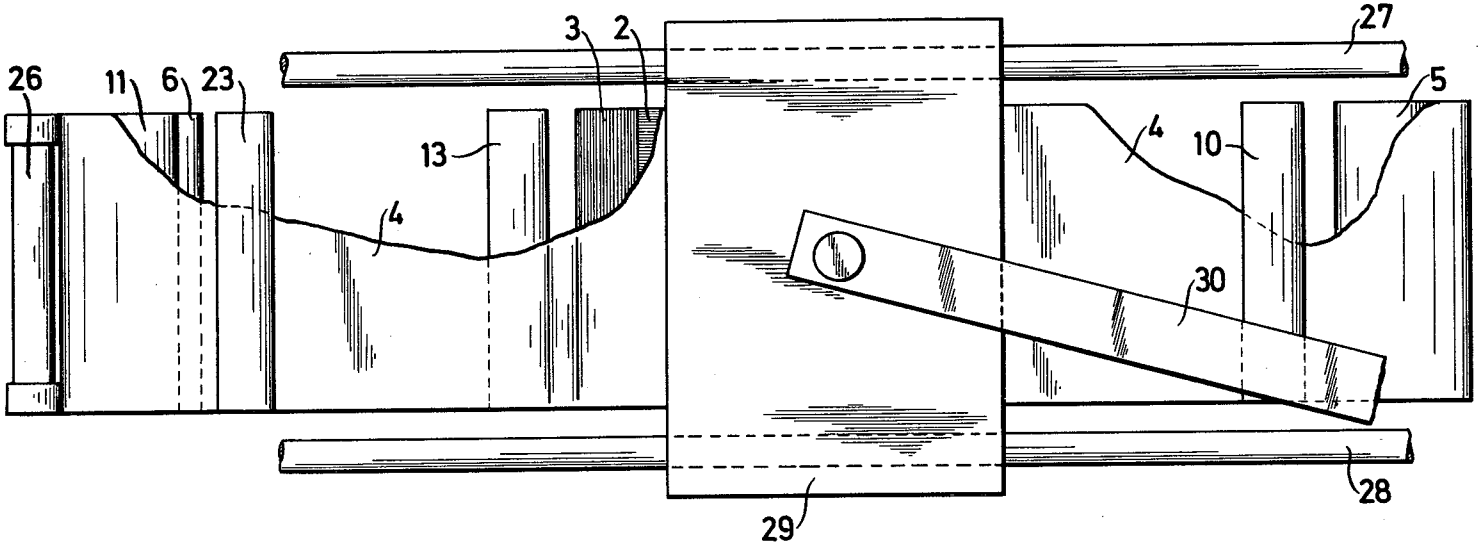

The entire sequence of operations may be accelerated by ensuring that the electrostatic charging of the recording material 4 is effected while the lifting device itself is still executing its return movement. FIGS. 6 to 8 are plan views of three different operational phases of such an apparatus. In FIG. 9, the arrangement is shown as a side elevation, the illustrated phase corresponding to that shown in FIG. 8.

FIG. 6 shows the charged recording material 4 during exposure. By a push rod system 30, a carriage 29 on the rods 27 and 28 (FIG. 9) may be pushed before the supporting plate T and back again. The carriage contains a corona 12 and a film guiding device comprising a small roller 31 at a distance of about 5 to 15 mm from the plane determined by the supporting plate T. In order to lift the recording material 4, the carriage is moved from its rest position (FIG. 6) past the supporting plate T, as shown in FIG. 7. At the same time, the pulleys 9 and 10 are closed and locked. Upon passage of the carriage, the recording material is lifted from the supporting plate T. At the turning point of the carriage, a short dwell is provided during which the pulleys 9 and 10 are released and the recording material 4 is moved forward by one section. Subsequently, the rolls 22 and 23 are closed and locked, and the carriage with the corona 12 is moved back into its rest position, at the same time charging the new section of recording material (FIG. 8).

It will be obvious to those skilled in the art that many modifications may be made within the scope of the present invention without departing from the spirit thereof, and the invention includes all such modifications.

What is claimed is:

1. An apparatus for peeling off an adherent, electrostatically charged, flexible recording material from an electroconductive supporting plate, said material being a film provided with a thermoplastic photoconductor layer, comprising electroconductive supporting plate means composed of a glass plate with a transparent electroconductive layer thereon which is provided with electrode means, said supporting plate means being adapted to contact one side of said material, guide means for the recording material arranged adjacent to the supporting plate means and so mounted as to project beyond an image plane on said supporting plate means in the direction in which said recording material is to be peeled off, holding element means positioned upstream of said guide means and said supporting plate means, and separating means for exerting a lateral pull on said recording material when said material is held by said holding means, whereby said material is progressively separated from said image plane in a wedge-like manner by said separating means.

2. An apparatus according to claim 1 in which said separating means is adapted to move in a straight path.

3. An apparatus according to claim 2 including charging means mounted on said separating means.

4. An apparatus according to claim 1 in which said holding element means and separating means are so mounted that they permit irradiation up to an angle of about 45° to the surface of said supporting plate means.

* * * * *